US005746042A

United States Patent [19]

Lombardi

[11] Patent Number: 5,746,042

[45] Date of Patent: May 5, 1998

[54] VIAL CAPPING DEVICE

[75] Inventor: Raymond A. Lombardi, Freehold, N.J.

[73] Assignee: Scientific Resources, Inc., Eatontown, N.J.

[21] Appl. No.: 626,562

[22] Filed: Apr. 2, 1996

[51] Int. Cl.[6] ..... B65B 7/28

[52] U.S. Cl. ..... 53/305; 53/308; 53/310

[58] Field of Search ..... 53/305, 308, 310, 53/329

[56] References Cited

U.S. PATENT DOCUMENTS

| | | | |
|---|---|---|---|
| 1,360,463 | 11/1920 | Strandt | 53/310 |
| 1,744,178 | 1/1930 | Taylor | 53/310 |
| 2,366,524 | 1/1945 | Harder | 53/305 |
| 2,841,939 | 7/1958 | Marceau | 53/310 |
| 2,914,901 | 12/1959 | Kinsley, Jr. et al. | 53/310 |
| 3,442,598 | 5/1969 | Shields . | |
| 3,491,454 | 1/1970 | Wright . | |
| 3,538,672 | 11/1970 | Shields . | |
| 3,852,941 | 12/1974 | Bross . | |
| 3,939,626 | 2/1976 | Cioni . | |
| 4,118,914 | 10/1978 | Shields . | |
| 4,807,425 | 2/1989 | Abrams . | |
| 4,841,818 | 6/1989 | Plapp . | |
| 4,980,969 | 1/1991 | Marchesini . | |
| 5,157,894 | 10/1992 | Mini . | |
| 5,157,897 | 10/1992 | McKee et al. | 53/308 |

*Primary Examiner*—Daniel Moon
*Assistant Examiner*—John Paradiso
*Attorney, Agent, or Firm*—Plevy & Associates

[57] ABSTRACT

A hand-held device for installing caps on vials having a housing with an outer housing member and an inner housing member. The housing is sized to enable the device to be held in a hand of a user and placed over a vial to be capped. A shuttle member is rotationally disposed within the inner housing for transporting one of a plurality of caps stored in the housing from a cap storage station to a cap installation station within the housing when said device is operated. At approximately the same time, a plunger extending from an inner surface of the outer housing is installs the cap transported to the cap installation station onto a vial. Also described is a cap to be used in the hand-held device. The cap has a substantially flat endwall defining a peripheral edge surface and a sidewall extending therefrom. The peripheral edge surface defines a radius which is substantially less than 0.040 inches. Such a radius substantially reduces the likelihood of the cap jamming when a plurality of the caps are used in the hand-held device described above.

17 Claims, 8 Drawing Sheets

VIAL CAPPING DEVICE

FIELD OF INVENTION

The present invention generally relates to vial capping devices and more particularly to a hand-held vial capping device which can be easily used by an operator in a mass production basis to cap a plurality of vials.

BACKGROUND OF THE INVENTION

The prior art includes many different devices and methods for automatically capping small glass vials in a mass production basis. Such vials are generally designed to contain a small quantity of liquid which is dispensed by a conventional hypodermic syringe. Accordingly, the vials are capped with a cap of the type that is either adapted to be pierced by the hypodermic syringe or be removed from the vial.

One such prior art vial capping device is disclosed in U.S. Pat. No. 3,538,672 entitled APPARATUS FOR DELIVERING CLOSURE CAPS TO VIALS issued to Shields on Nov. 10, 1970. The Shields patent discloses a device including a conveyer for receiving vials from a vial feeding and positioning device and subsequently presenting the vials to an apparatus for filling with a liquid medicament. A reciprocating closure cap delivery chute aligns a cap over each of the filled vials and a plunger raises the vial to its associated cap where a crimping mechanism then secures the cap to the vial. U.S. Pat. No. 3,852,941 entitled VIAL CAPPING APPARATUS issued to Bross on Dec. 10, 1974 describes a motor driven rotary worktable with eight vial capping workstations. Each vial capping workstation includes a vial capping device which is mounted directly to the periphery of the worktable. The vial capping device includes a cam-actuated vial holder for holding a filled vial and a cam-actuated cap holder which positions the cap on the vial and rotates the cap under pressure onto the vial Other vial capping devices can be found in the prior art. In U.S. Pat. No. 3,939,626 entitled MACHINE FOR AUTOMATIC FILLING AND SEALING OF GLASS VIALS issued to Cioni et al. on Feb. 24, 1976, a conveyer device with vial holding receptacles is disclosed. Needles and syringes are employed in the device for filling the vials held on the conveyer while burners and vial pinching devices are provided for sealing the filled vials. Similarly, in U.S. Pat. No. 4,118,914 entitled VIAL ASSEMBLER issued to Shields on Oct. 10, 1978, an automatic vial filling and capping device is disclosed which includes two turrets each having a plurality of notches for receiving vials. The first turret is associated with a vial filling station and the second turret is associated with a stations for plugging and capping the vials. Means are provided for automatically transferring the vials from the first turret to the second turret. Accordingly, vials are fed onto the first turret where they are filled with a liquid. After filling the vials are automatically transferred from the first turret to the second turret for capping.

Another automatic vial capping device is disclosed in U.S. Pat. No. 4,807,425 entitled METHOD AND DEVICE FOR OPENING AND CLOSING VIALS issued to Abrams on Feb. 28, 1989. The device includes a rack for supporting a plurality of vials. The device further includes a first pneumatically operated piston for sequentially lifting the cap from each of the supported vials, an upwardly sloping bar for raising the cap off its respective vial, a downwardly sloping bar for lowering the cap onto its respective vial and a second pneumatically operated piston for closing the cap onto its respective vial.

A rotating multi-station device for installing caps on vials is disclosed in U.S. Pat. No. 4,980,969 entitled ROTATING MULTI-STATION MACHINE FOR INSERTING AN UNDER-PLUG IN VIALS AND SIMILAR CONTAINERS issued to Marchesini on Jan. 1, 1991. The device includes a rotating drum which features vial gripping means disposed along the periphery of the rotating drum. Also disposed along the periphery of the drum are angularly equidistant insertion devices for inserting the plugs in the vials. A distributor carousel is provided for delivering plugs and vials to the rotating drum.

The vial capping devices described above are complex multi station devices that are complex and thus, relatively expensive to manufacture. Many of these devices have been adapted to be usable with various sized caps and vials and thus, require a great deal of skill to setup and adjust.

Moreover, there are many situations where such complicated vial capping devices are not practical. For example, these elaborate prior art capping devices don't lend themselves well to small laboratories such as those found in hospitals and medical offices where a lab or medical technician could advantageously make use of a simple and easy to use hand-held device for installing caps onto a plurality of vials held upright in a tray.

Accordingly, there is a need for a hand held vial capping device that can be easily operated to install vial caps in laboratory and like settings.

SUMMARY OF THE INVENTION

A hand-held device for installing caps on vials, comprising a housing having a cap storage station and a cap installation station remote from said cap storage station. The cap storage station being operative for storing a cartridge containing a plurality of caps, the housing having a predetermined size which enables the device to be held in a hand of a user and placed over a vial to be capped.

The device also includes a shuttle means disposed within the housing for transporting one of the caps from the cap storage station to the cap installation station within the housing when the device is operated. Plunger means disposed within the housing installs a cap, transported to the cap installation station, onto a vial when the device is operated.

Also disclosed is a cap to be used in the hand-held device described above. The cap has a substantially flat endwall defining a peripheral edge surface and a sidewall extending therefrom. The peripheral edge surface defines a radius which is substantially less than 0.040 inches. Such a radius substantially reduces the likelihood of the cap jamming when a plurality of the caps are used in the hand-held device.

BRIEF DESCRIPTION OF THE DRAWINGS

For a detailed understanding of the present invention, reference should be made to the following detailed description taken in conjunction with the accompanying drawings wherein.

DETAILED DESCRIPTION OF THE INVENTION

Figure 1:
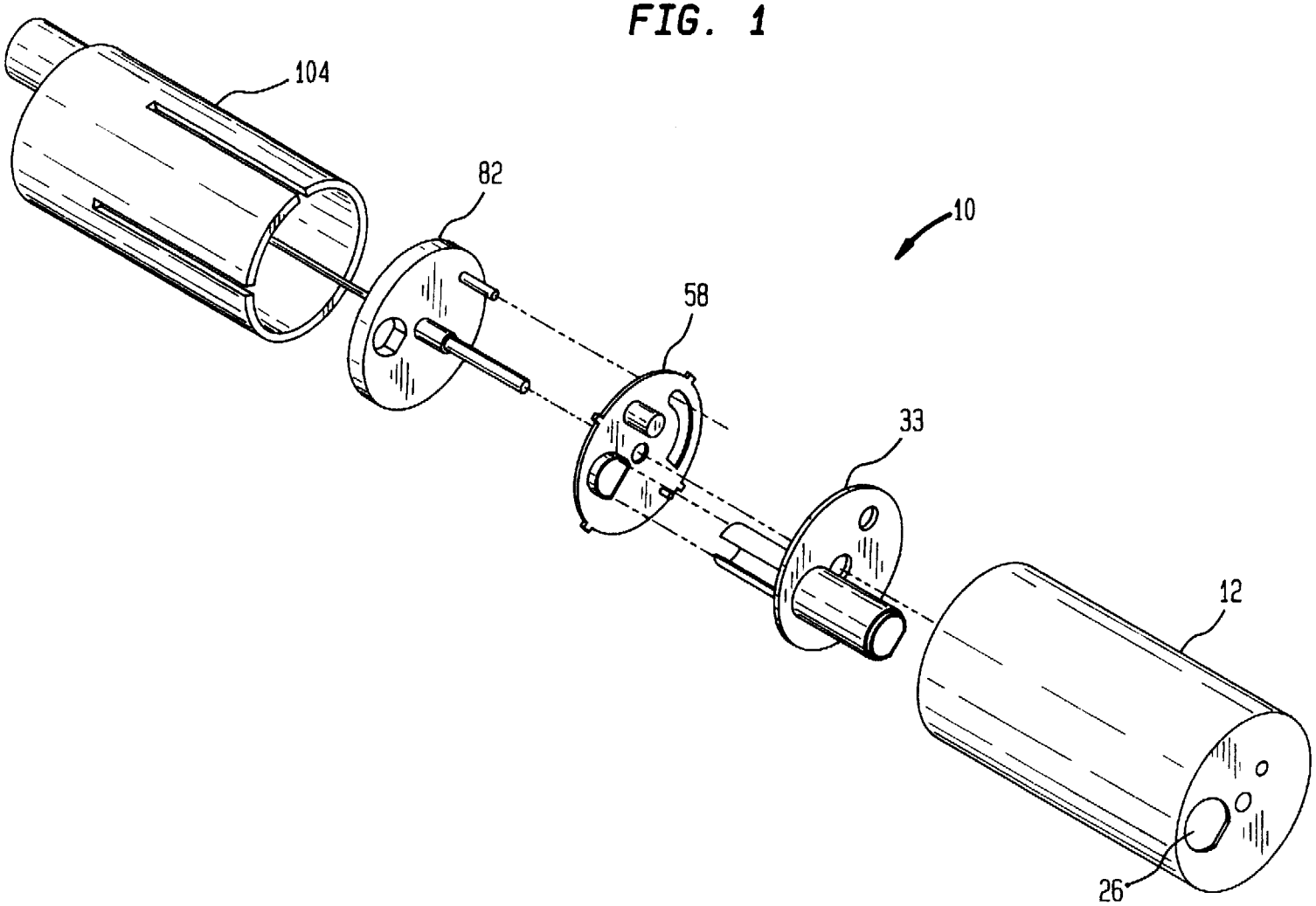
FIG. 1 is an exploded perspective view of a hand-held capping device of the present invention.
Figure 2B:
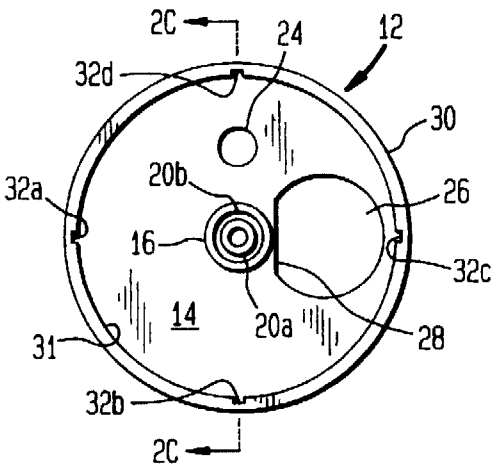
FIG. 2B is a bottom view of the outer housing.
Figure 2E:
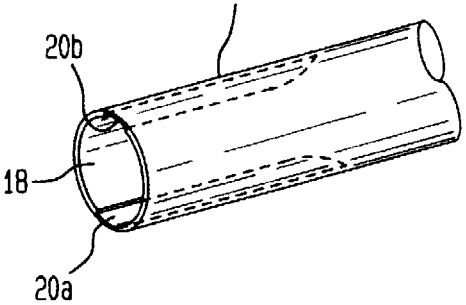
FIG. 2E is a enlarged view of an elongated tubular member of the outer housing.
Figure 2D:
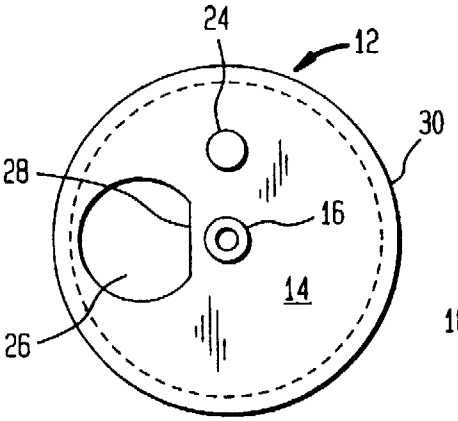
FIG. 2D is a top view of the outer housing.
Figure 2A:
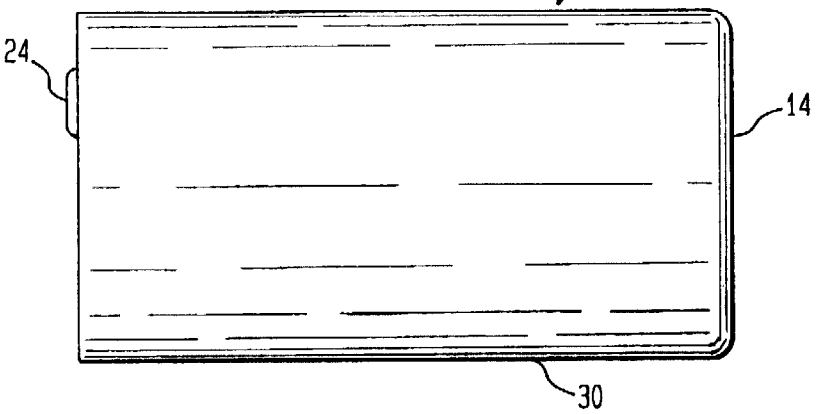
FIG. 2A is a side view of an outer housing of the capping device of FIG. 1.
Figure 2C:
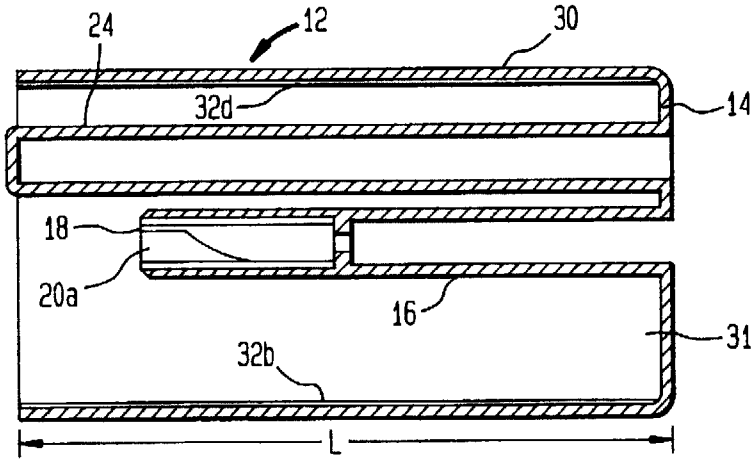
FIG. 2C is a cross-sectional view through line 2C—2C of FIG. 2B.
Figure 3A:
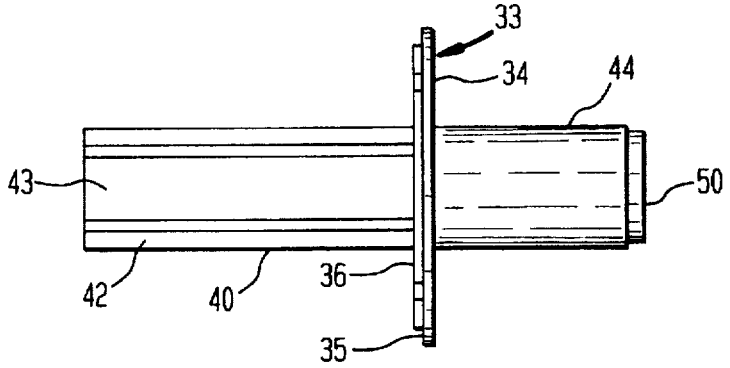
FIG. 3A is a side view of a tube table of the capping device of FIG. 1.
Figure 3B:
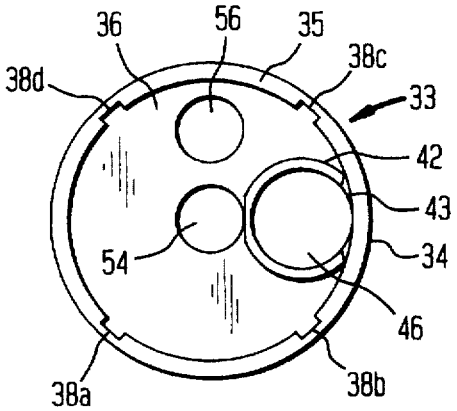
FIG. 3B is a bottom view of the tube table.
Figure 3C:
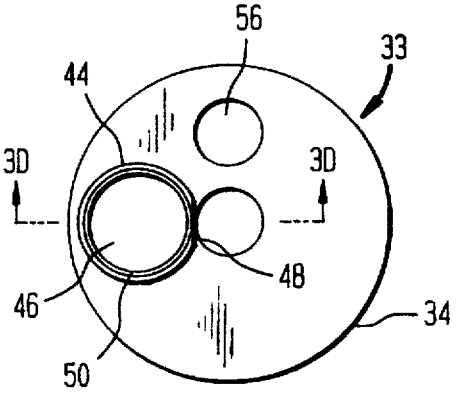
FIG. 3C is a top view of the tube table.
Figure 3D:
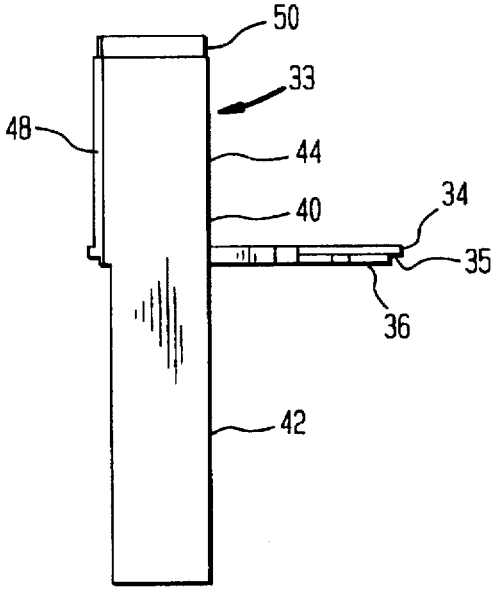
FIG. 3D is a cross sectional view through line 3D—3D of FIG. 3C.
Figure 4A:
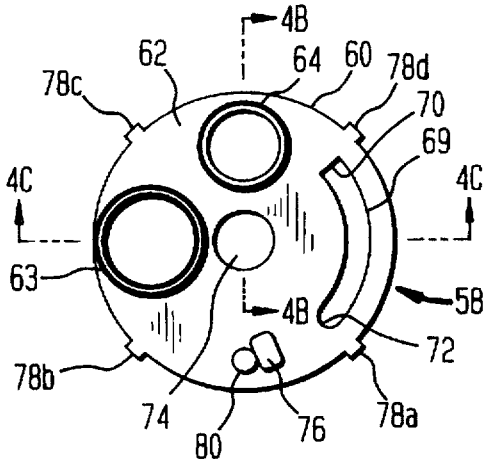
FIG. 4A is a top view of a shuttle table of the capping device of FIG. 1.
Figure 4B:
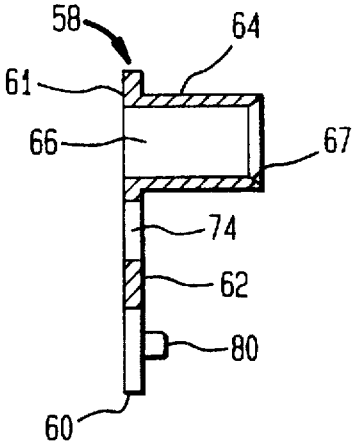
FIG. 4B is a cross-sectional view through line 4B—4B of FIG. 4A.
Figure 4C:
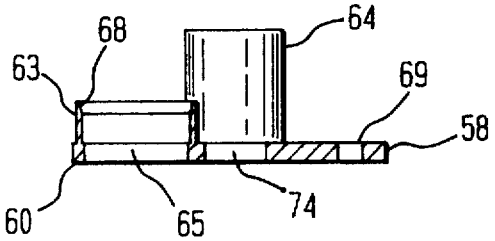
FIG. 4C is a cross-sectional view through line 4C—4C of FIG. 4A.
Figure 4D:
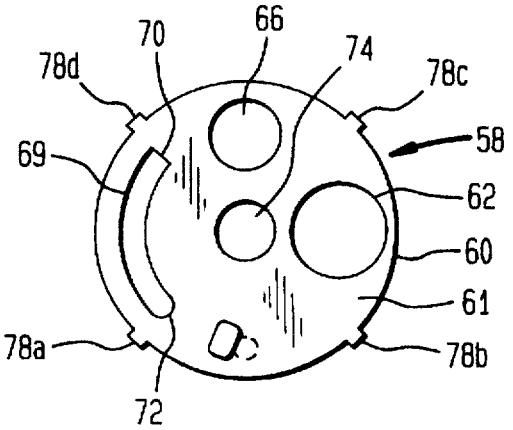
FIG. 4D is a bottom view of the shuttle table.
Figure 4E:
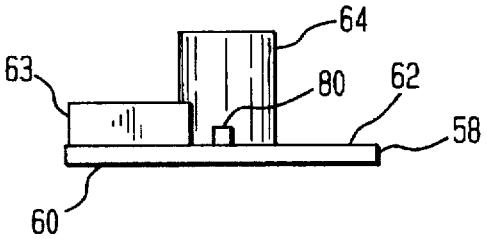
FIG. 4E is a side view of the shuttle table.
Figure 5A:
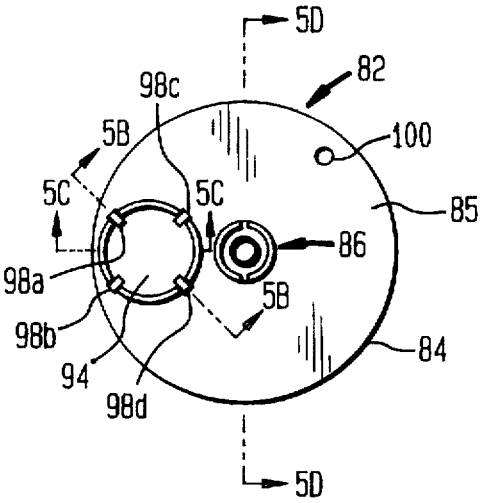
FIG. 5A is a bottom view of the shuttle plate of the capping device of FIG. 1.
Figure 5B:
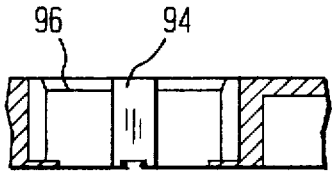
FIG. 5B is a cross-sectional view through line 5B—5B of FIG. 5A.
Figure 5C:
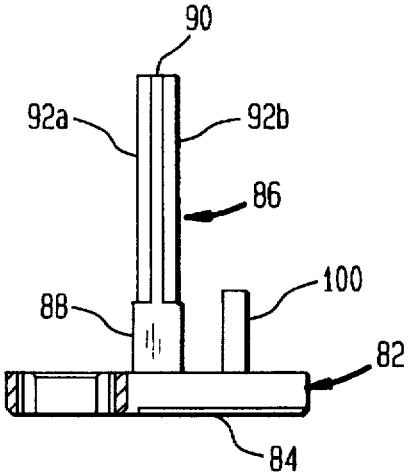
FIG. 5C is a cross-sectional view through line 5C—5C of FIG. 5A.
Figure 5D:
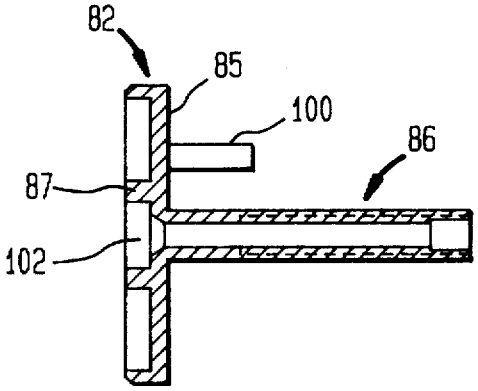
FIG. 5D is a cross-sectional side view through line 5D—5D of FIG. 5A.
Figure 5E:
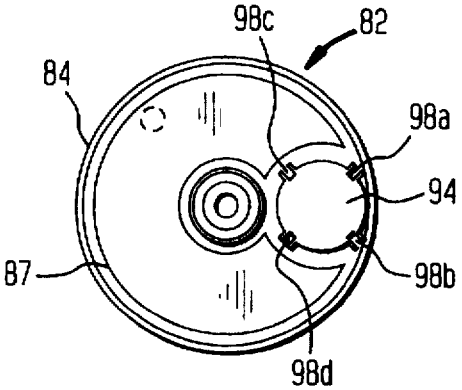
FIG. 5E is a top view of the shuttle plate.
Figure 6A:
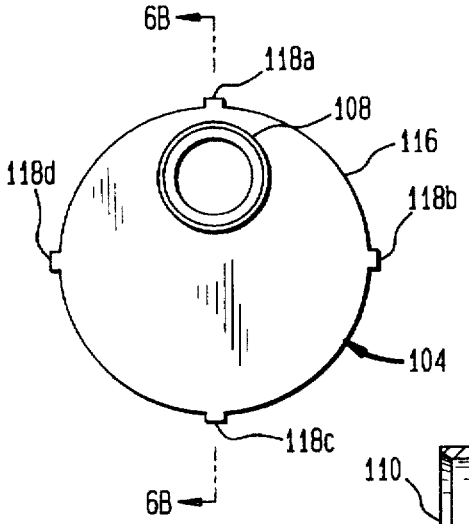
FIG. 6A is top view of an inner housing of the capping device of FIG. 1.
Figure 6B:
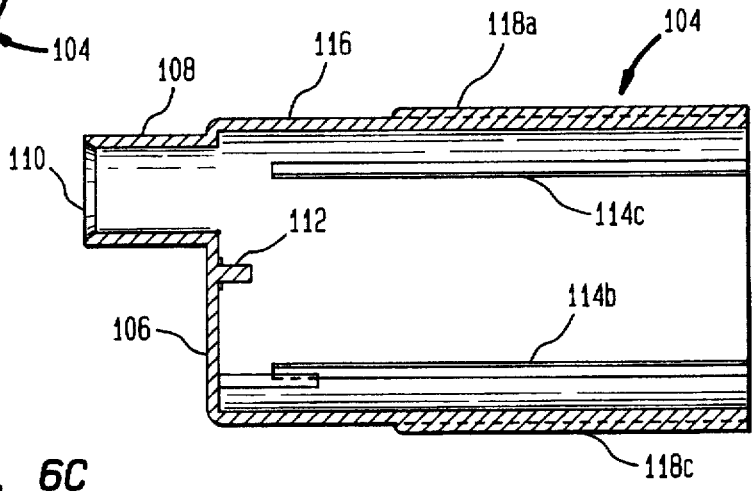
FIG. 6B is a cross-sectional view through line 6B—6B of FIG. 6A.
Figure 6C:
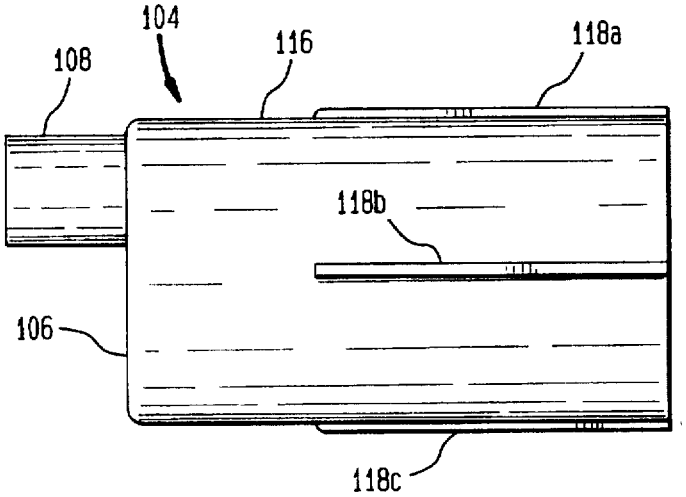
FIG. 6C is a side view of the inner housing.
Figure 6D:
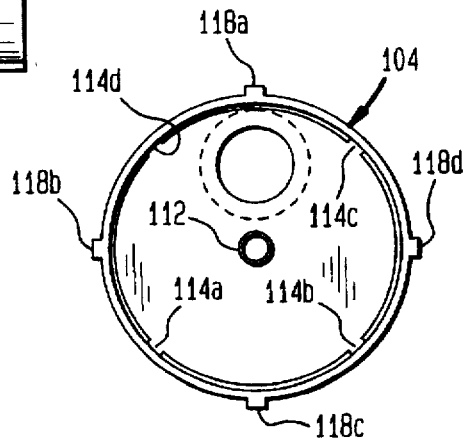
FIG. 6D is a bottom view of the inner housing.

Referring to FIG. 1, there is shown an exploded perspective view of a hand-held vial capping device 10 made in accordance with the present invention. The capping device 10 is essentially comprised of 5 major components. The components consist of a shuttle plate 82 and a shuttle table 58 which are assembled into a cylindrically shaped inner housing 104, and an outer housing or cover 12 containing a tube table 33 telescopically assembled over the inner housing 104. The capping device 10 is simple, and easy to use as will be explained and has an overall diameter of less than 2.5 inches which makes the device 10 easy to hold in by user's having relatively small hands.

The capping device 10 of the present invention is especially suited for installing caps (SNAP CAPS) manufactured and sold by Scientific Resources Inc., the assignee herein. It should be understood, however, that the device 10 can be adapted to install other manufacturer's caps as well if desired.

Referring to FIGS. 2A–2E, the outer housing 12 includes an end wall 14 and a cylindrically shaped sidewall 30 extending from the periphery thereof. Extending into the interior of the outer housing 12 from the a central location of the end wall 14 is an elongated tubular member 16. The elongated tubular member 16 includes opposing cam grooves 20A and 20B (best seen in FIG. 2E) defined on an inner surface 18 thereof. Each cam groove 20A and 20B extends axially along the inner surface 18 of the tubular member. The end portion of each cam groove 20A and 20B tapers toward one side of the groove in the direction indicated by the arrows. A rod-shaped cap plunger 24 oriented laterally from the tubular member 16 also extends from the end wall 14 to point just beyond the free edge of the sidewall 30. A generally circular aperture 26 having a flat 28 is defined in the end wall 14 at a location laterally adjacent to the tubular member 16. The aperture 26 allows a refillable tubular cartridge of caps to be loaded into the device 10. The flat 28 portion of the aperture ensures that the cap cartridge is installed in the device the proper orientation.

Still referring to FIGS. 2A–2D, the sidewall 30 includes four equi-spaced grooves **32*a–d* defined in the inner surface 31 thereof. The grooves 32*a–d* extend along the entire length L of the sidewall inner surface 31 and cooperate with ridges on the inner housing 104 of the device 10** as will be later explained.

Referring to FIGS. 3A–3D the tube table 33 comprises a disc-shape member 34 having a first surface 35 with a raised surface region 36 which faces the inner housing 104 when the device 10 is assembled. The circumferentially extending unraised portion of the first surface 35 of the member 34 defines a stop surface for the inner housing 104. Extending radially from the periphery of the raised surface region 36 are 4 equi-spaced tabs **38*a–d*. In the assembled state, the tube table 33 is disposed in the outer housing 12. When the device 10 is operated the outer housing 12 is compressed over the inner housing 104 such that the tabs 38*a–d* of the tube table 33 enter corresponding grooves in the inner housing 104 just as the free edge of the inner housing sidewall abuts against the first surface 35 of the tube table 33** as will be further explained.

Further in FIGS. 3A–3D, a cap cartridge guide tube 40 for receiving the tubular cartridge of cabs extends through the disc shape member 34 and includes a first tube portion 42 and a second tube portion 44 which extend from the opposite sides of the disc shape member 34. An aperture 46 defined in the disc shape member 34 allows the first and second tube portions 42 and 44 to communicate with each other. Extending along the entire length of the first tube portion 42 is a slot 43. The second tube portion includes flat surface portion 48 which extends the entire length thereof. The free end of the second tube portion 44 includes a circumferential relief 50.

The disc-shape member 34 of the tube table 33 also includes a centrally located aperture 54 which allows passage therethrough of the tubular member 16 of the outer housing 12. Disposed laterally to the central aperture 54 is a second aperture 56 which allows the passage therethrough of the rod-shaped cap plunger 24 of the outer housing 12.

Referring to FIGS. 4A–4E the shuttle table 58 comprises a disc-shaped member 60 having a first surface 61 and a second surface 62. A pair of tube like extensions 63 and 64 extend from the second surface 62 of the disc-shaped member 60, the shorter tube 63 (see in particular FIGS. 4C and 4E) operating to receive the tubular cap cartridge and the longer tube 64 operating as a guide bushing for the plunger 24 of the outer housing 12. The free end of each tube extension 63 and 64 includes a respective chamfered lead-in edge surface 67 and 68. Apertures 65 and 66 are defined in the member 60 at the base of each respective tube extension 63 and 64. The apertures 65 and 66 allow the respective passage of a cap cartridge and the plunger 24 of the outer housing 12 through the shuttle table 58. An elongated-arcuate-shaped aperture 69 having a first end 70 and a second end 72 is defined in the disc shape member 60 at a location opposite to the tube extension 63. The aperture 69 allows a spring post 100 (see FIG. 7C) which extends from the shuttle plate 82 to extend through the shuttle table 58. A centrally located aperture 74 is also defined in the member 60 and allows the passage therethrough of a shuttle plate drive shaft member 86. A spring post 80 extends from the second surface 62 of the member 60. Located immediately adjacent to the spring post 80 is a rectangular-shaped aperture 76. Four equi-spaced tabs 78*a–d* extend from the periphery of the disc shape member 60. The tabs 78*a–d* coact with corresponding grooves associated with the inner housing 104 to prevent relative rotation between the shuttle table 58 and the inner housing 104.

In FIGS. 5A–5E the shuttle plate 82 also comprises a disc shape member 84 having a first surface 85 and a second surface 87. Extending centrally from the first surface 85 of the shuttle member 82 is a shuttle plate drive shaft member 86. The drive shaft member 86 includes a base portion 88 and extension shaft 90 extending from the base portion 88. The extension shaft 90 includes two oppositely extending radiused flange members 92A and 92B. The base portion 88 of the drive shaft member 86 rotates within the central aperture 74 of the shuttle table 58 to maintain axial alignment between the shuttle plate 82 and shuttle table 58. The extension shaft 90 extends through the device 10 and into the tubular member 16 of the outer housing 12. The radiused flange members 92A and 92B of the extension shaft engage the cam grooves 20A and 20B of the tubular member 16 of the outer housing 12 such that when the outer housing 12 is pushed down relative to the inner housing 104, the tapered portion of the cam grooves 20A and 20B coact with the radiused flange members 92A and 92B to create a twisting motion of the drive shaft member 86 which in turn rotates the shuttle plate 82.

Also extending from the first surface 85 of the disc shape member 84 laterally offset from the drive shaft member 86, is a second spring post 100. An aperture 94 for shuttling a cap from the tubular cap cartridge to an area within the inner housing 104 where it will be driven out of the device 10 onto a vial as will be explained. The aperture 94 is located laterally from the centrally located drive shaft member 86. The aperture 94 includes a chamfered edge surface 96 adjacent the first surface 85 and four elastically resilient spring tabs 98*a–d* adjacent the second surface 87 of the disc shape member 84. The second surface 87 of the shuttle plate 82 includes a centrally located aperture 102 which extends through the drive shaft member 86.

Referring now to FIGS. 6A–6D the inner cylindrical housing 104 includes an end wall 106 and a side wall 116 extending from the periphery of the end wall 106. The inner housing 104 has a diameter which allows the inner housing 12 to reciprocate in and out of the outer housing 12 in a telescoping manner. Extending from the end wall 106 is a cylindrically shaped neck extension 108. The cylindrical neck extension 108 includes a chambered edge 110 and has an inner diameter which is sized to enable the neck extension 108 to be placed over the outer surface of the vials to be capped. A centrally disposed shuttle plate guide pin 112 extends from the inner surface of the end wall 106 and is received within the central aperture 102 of the shuttle plate 82 so that the shuttle plate 82 can be rotated relative to the inner housing 104. Four alignment ridges 118*a–d* are disposed on the outer surface of the inner housing sidewall 116. The alignment ridges 118*a–d* ride in the alignment grooves 32*a–d* on the inner surface of the outer housing 12. Four alignment grooves 114*a–d* are defined along the inner surface of the side wall 116 and receive the alignment tabs 78*a–d* of the shuttle table 58 to prevent relative rotation of the shuttle table 58 when the device 10 is operated.

Figure 7A:
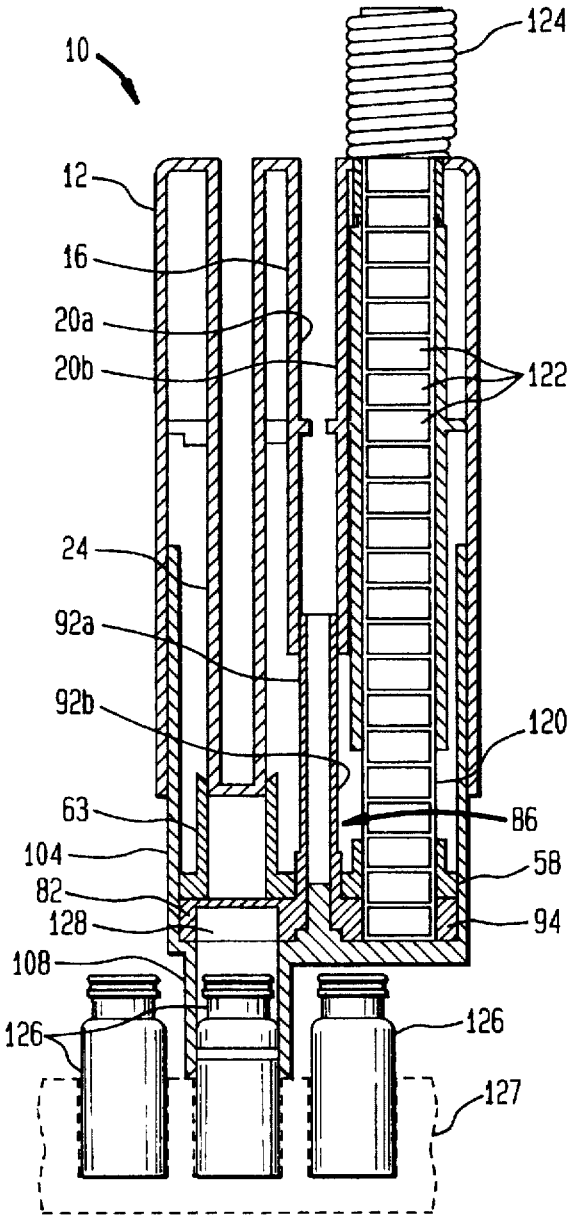
FIG. 7A is a side cross-sectional view of the capping device in a resting position mounted over a vial to be capped.
Figure 7B:
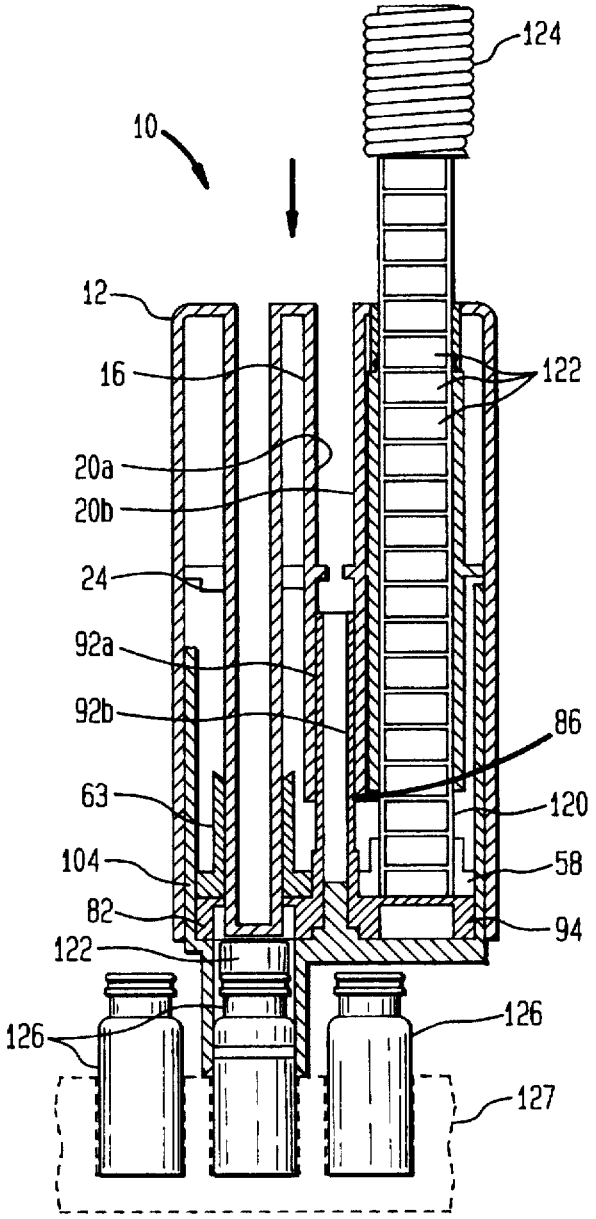
FIG. 7B is a side cross-sectional view of the capping device in a compressed position installing a cap onto the vial.
Figure 7C:
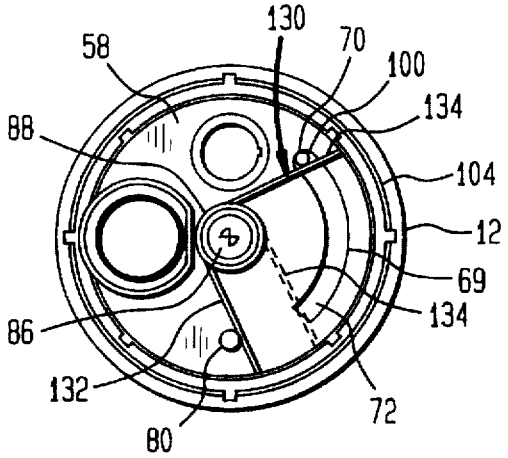
FIG. 7C is a top cross-sectional view of the capping device at the level of the shuttle table.

Referring now to FIGS. 7A–7C, the operation of the capping device 10 will be described. FIG. 7A shows the capping device 10 at rest and loaded with a refillable tubular cartridge 120 of caps 122. The cartridge 120 is generally adapted to hold approximately 25 caps (SNAP CAPS) available from Scientific Resources, Inc. the assignee herein, although the cartridge can be easily adapted to hold caps available from other manufacturers. Further, the cartridge 120 can also be configured to hold more or less than 25 caps. A spring 124 attached to the top of the cartridge 120 is used to preload the caps to prevent jamming of the caps in the cartridge. The upper portion of the spring 124 is coupled to the top of the cartridge 120 while the bottom of the spring 124 applies a bias to the caps 122.

The neck extension 108 of the capping device 10 is shown in FIG. 7A, in position over the outer surface of a vial 126 sitting in a tray 127 with other vials 126 to be capped and a cap 122 has been fed into the cap shuttle aperture 94. The cap 122 rests on the 4 elastically resilient spring tabs 98*a–d* (not visible) at the bottom of the aperture 94.

In FIG. 7B, the user then uses the palm of his or her hand to compress the outer housing 12 of the device 10 over the inner housing 104. As the outer housing 12 moves down relative the inner housing 104, the cam grooves 20A and 20B coact with the radiused flange members 92A and 92B to create a twisting motion of the drive shaft member 86 which in turn rotates the shuttle plate 82 to deliver the cap held within aperture 94 to an area 128 within the inner housing 104 directly over the opening of the neck extension 108. Just as this occurs, the plunger 24 engages the cap and forces it past the resilient spring tabs 98*a–d* which bend to allow passage of the cap 122 through the aperture 94. As the outer housing 12 is fully compressed, the plunger 24 advances down toward the vial 126 through the plunger guide bushing 63 of the shuttle table 58 and the aperture 94 of the shuttle plate 82 where the plunger 24 partially enters to extension tube to fully seat the cap 122 onto the vial 126.

After the outer housing 12 is released, a shuttle plate return spring 130 rotates the shuttle plate 82 back to its original position as shown in FIG. 7C. The shuttle plate return spring 130 loops around the base 88 of the drive shaft member 86 and includes first and second arms 132 and 134. The first arm 134 abuts against the spring post 80 of the shuttle table 58 while the second arm 134 abuts against the second spring post 100 of the shuttle plate 82 and thus, biases the second spring post 80 against the first end 70 of the elongated-arcuate-shaped aperture 69 when the capping device 10 is in the rest position. When the shuttle plate 82 is rotated relative to the shuttle table 58 during operation of the device 10, the spring post 100 travels from the first end 70 to the second end 72 of the aperture 69. When the outer housing is released, the spring bias built up between the spring posts forces the shuttle plate 82 to its original rotational position which creates a reverse twisting motion of the drive shaft member 86 that operates to return the outer housing 12 to its original uncompressed position of FIG. 7A.

Figure 8A:
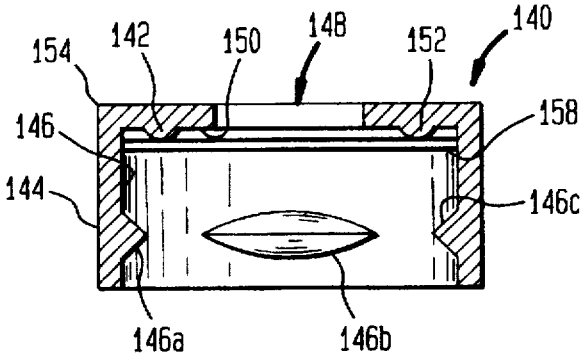
FIG. 8A is a side cross-sectional view of a cap designed for the capping device of the present invention.

Referring to FIG. 8A, there is shown the preferred cap 140 for use in the capping device 10 of the present invention. The cap 140 includes a substantially flat circular end wall 142 and a cylindrically-shaped sidewall 144 depending from the periphery of the end wall 142. The inner surface 146 of the sidewall 144 includes four (only three visible) snap beads 146*a–c* which have a triangular cross-section. The snap beads coact with a lip or other like structure on the vial (not shown) to retain the cap 140 to the vial. A centrally disposed aperture 148 is defined in the end wall 142 of the cap 140. The end wall 142 also includes a circumferentially extending sealing bead 152 disposed on the inner surface 150 thereof. A liner 158 underlies the end wall 142 and is composed of a resilient material such as silicone rubber. The resilient liner 158 facilitates puncturing with a needle or syringe through aperture 148. In order to substantially reduce the possibility of the cap 140 jamming in the tubular cap cartridge described earlier, the peripheral top edge surface 154 of the cap 140 where the end wall 142 merges into the 144 sidewall defines a radius which does not exceed 0.010 inches. In comparison, the peripheral top edge surface of the prior art caps 156 shown in FIG. 8B define a radius which is typically on the order of 0.040 inches.

Figure 8B:
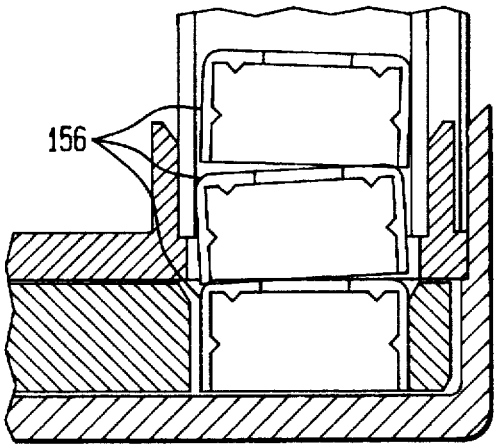
FIG. 8B depicts prior art caps stacked within a cap cartridge that is installed in the capping device of the present invention.

As shown in FIG. 8B, prior art caps 156 have a much higher jamming potential than the caps 140 made in accordance with the present invention. The rounded 0.040 radius of the peripheral top edge surface of the prior art caps 156 allow the caps to slide down over each other. This causes the caps 156 to rotate slightly within the tubular cap cartridge, thereby increasing the likelihood of jamming.

Figure 8C:
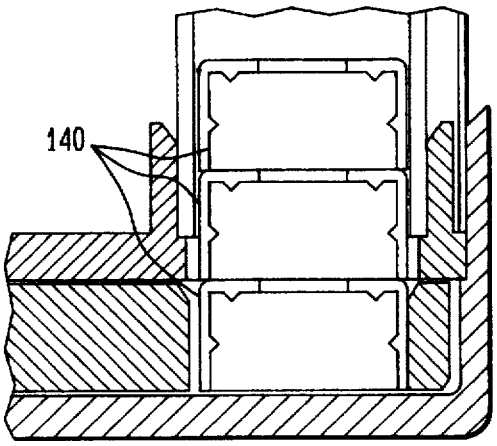
FIG. 8C depicts caps made according to the present invention stacked within a cap cartridge that is installed in the present invention capping device.

In contrast, as shown in FIG. 8C, the present invention caps 140 can not easily slide down over each other due to the small 0.010 inch radius of the peripheral to edge surface. Thus, the caps 140 have a substantially reduced tendency to rotate within the tubular cap cartridge which greatly reduces the likelihood of jamming.

It should be understood that the embodiments described herein are merely exemplary and that a person skilled in the art may make many variations and modifications to the embodiments utilizing functionally equivalent elements to those described herein. Any and all such variations or modifications as well as others which may become apparent to those skilled in the art, are intended to be included within the scope of the invention as defined by the appended claims.

What is claimed is:

1. A hand-held device for installing caps on vials, comprising:

a housing of predetermined size which enables said device to be held in a user's hand and be placed over a vial, said housing including: an inner housing portion, an outer housing portion, said outer housing portion being pressable into contact with said vial when said device is operated, and said outer housing portion being moveable with respect to said inner housing portion when said device is operated, a cap storage station for storing a cartridge containing a plurality of caps, and a cap installation station remote from said cap storage station;

shuttle means disposed within said housing for transporting one of said caps from said cap storage station to said cap installation station within said housing when said device is operated; and, plunger means disposed within said housing for installing a cap transported to said cap installation station onto said vial when said device is operated;

wherein, said device, when operated by moving said outer housing portion with respect to said inner housing portion, affixes a cap upon said vial.

2. The device according to claim 1, wherein said inner housing portion reciprocates in and out of said outer housing portion when said outer housing portion is moved with respect to said inner housing portion to operate said device.

3. The device according to claim 2, wherein one of said inner and outer housing portions includes cam means for actuating said shuttle means when said outer housing portion is moved with respect to said inner housing portion.

4. The device according to claim 1, wherein said shuttle means includes shuttle drive means for rotating said shuttle means from said cap storage station to said cap installation station.

5. The device according to claim 4, further comprising biasing means for rotating said shuttle means from said cap installation station to said cap storage station when said device is at rest.

6. The device according to claim 4, wherein said shuttle drive means includes cam means associated with said housing.

7. The device according to claim 6, wherein said inner housing portion reciprocates in and out of said outer housing portion when said outer housing portion is moved with respect to said inner housing portion to operate said device.

8. The device according to claim 7, wherein one of said inner and outer housing portions includes said cam means which rotates said shuttle means when said outer housing portion is moved with respect to said inner housing portion to operate said device.

9. The device according to claim 1, further comprising cartridge holding means disposed within said housing.

10. The device according to claim 1, wherein said housing includes vial mounting means for enabling said device to be mounted over a vial to be capped.

11. A hand-held device for installing caps on vials, comprising:

a housing having a predetermined size which enables said device to be held in a hand of a user and placed over a vial, said housing including an inner housing portion, and an outer housing portion, said outer housing portion being pressable into contact with said vial when said device is operated, and said outer housing portion being moveable with respect to said inner housing portion when said device is operated;

a shuttle means rotationally disposed within said inner housing portion for transporting one of a plurality of caps stored in said housing from a cap storage station to a cap installation station within said housing when said device is operated; and, a plunger associated with said outer housing portion for installing a cap transported to said cap installation station onto a vial when said device is operated;

wherein, said device, when operated by moving said outer housing portion with respect to said inner housing portion, affixes a cap upon said vial.

12. The device according to claim 11, wherein said shuttle means includes shuttle drive means for rotating said shuttle means from said cap storage station to said cap installation station.

13. The device according to claim 12, further comprising biasing means for returning said shuttle means from said cap installation station to said cap storage station when said device is at rest.

14. The device according to claim 12, wherein said shuttle drive means includes cam means associated with said outer housing portion.

15. The device according to claim 14, wherein said inner housing portion reciprocally moves in and out of said outer housing portion when said outer housing portion is moved with respect to said inner housing portion to operate said device.

16. The device according to claim 11, further comprising cartridge holding means disposed within said outer housing portion.

17. The device according to claim 11 wherein said inner housing portion includes vial mounting means for enabling said device to be mounted over a vial to be capped.

* * * * *